US010448751B2

(12) United States Patent
Troutman

(10) Patent No.: US 10,448,751 B2
(45) Date of Patent: Oct. 22, 2019

(54) PLAY YARDS AND METHODS OF OPERATING THE SAME

(71) Applicant: Kolcraft Enterprises, Inc., Chicago, IL (US)

(72) Inventor: Damon Oliver Casati Troutman, Lake Forest, IL (US)

(73) Assignee: KOLCRAFT ENTERPRISES, INC., Chicago, IL (US)

( * ) Notice: Subject to any disclaimer, the term of this patent is extended or adjusted under 35 U.S.C. 154(b) by 412 days.

(21) Appl. No.: 15/065,373

(22) Filed: Mar. 9, 2016

(65) Prior Publication Data

US 2016/0183697 A1 Jun. 30, 2016

Related U.S. Application Data

(63) Continuation of application No. 14/677,579, filed on Apr. 2, 2015, now Pat. No. 9,314,115, which is a continuation of application No. 13/947,864, filed on Jul. 22, 2013, now Pat. No. 9,027,180, which is a continuation of application No. 12/494,932, filed on Jun. 30, 2009, now Pat. No. 8,490,227, which is a continuation of application No. 11/063,811, filed on Feb. 23, 2005, now Pat. No. 7,568,242.

(51) Int. Cl.
*A47D 13/06* (2006.01)

(52) U.S. Cl.
CPC ..... *A47D 13/063* (2013.01); *A47D 13/061* (2013.01); *A47D 13/066* (2013.01)

(58) Field of Classification Search
CPC ... A47D 13/061; A47D 13/063; A47D 13/066
USPC ..... 5/98.1, 99.1, 93.1, 93.2, 97, 406, 407, 5/402, 403; 297/440.11, 452.63, 452.13, 297/452.12
See application file for complete search history.

(56) References Cited

U.S. PATENT DOCUMENTS

| | | | |
|---|---|---|---|
| 548,901 | A | 10/1895 | Welch |
| 607,096 | A | 7/1898 | Thacher |
| 633,353 | A | 9/1899 | Bacon |
| 914,309 | A | 3/1909 | Ross |

(Continued)

FOREIGN PATENT DOCUMENTS

| | | |
|---|---|---|
| AU | 715883 | 2/2000 |
| WO | 2006017966 | 2/2006 |

OTHER PUBLICATIONS

United States Patent and Trademark Office, "Final Written Decision," issued in connected with Case No. IPR2016-00816 and Case No. IPR 2016-00826 on Oct. 2, 2017, 21 pages.

(Continued)

*Primary Examiner* — Robert G Santos
(74) *Attorney, Agent, or Firm* — Hanley, Flight & Zimmerman, LLC

(57) ABSTRACT

Play yards and methods of operating the same are disclosed. An example play yard includes a collapsible upper frame, a collapsible lower frame, and posts to support the upper frame above the lower frame. The posts include respective tracks. The example play yard also includes an enclosure operatively coupled to the upper frame, the lower frame and the posts. The enclosure defines an enclosure volume. The enclosure has a plurality of corner beads dimensioned for receipt in respective ones of the tracks to secure the enclosure to the posts.

16 Claims, 7 Drawing Sheets

(56) References Cited

U.S. PATENT DOCUMENTS 929,792 A 8/1909 Seifert
1,105,156 A 7/1914 Oliphant
1,183,819 A 5/1916 Keiser
1,187,845 A 6/1916 Kolb
1,374,333 A 4/1921 Stotler et al.
1,407,681 A 2/1922 Saunders
1,429,869 A 9/1922 Gowell
1,499,821 A 7/1924 Griffiths
1,669,484 A 5/1928 Mowry
1,695,571 A 12/1928 Baxter
1,753,875 A 4/1930 Baumann
1,757,241 A 5/1930 Forse
1,839,580 A 1/1932 Myron
1,975,332 A 10/1934 Rehkoff
2,015,280 A 9/1935 Morishita
2,194,320 A 3/1940 Pearson
2,245,961 A 6/1941 Clay
2,287,907 A 6/1942 Schettler, Jr.
D145,052 S 6/1946 Boisselier
2,415,186 A 2/1947 Moore
2,420,898 A 5/1947 Miner
D158,030 S 4/1950 Wagner
2,508,506 A 5/1950 Fridolph
2,523,422 A 9/1950 Dunn
2,566,594 A 9/1951 Brown
2,590,315 A 3/1952 Hawley, Jr.
2,617,999 A 11/1952 Mitchell
2,698,443 A 1/1955 Ralick
2,784,420 A 3/1957 Moltane
2,790,184 A 4/1957 Testa
2,790,978 A 5/1957 Tigrett
D181,893 S 1/1958 Bargen
2,873,458 A 2/1959 Adamson
2,895,717 A 7/1959 Falco
D186,358 S 10/1959 Fulton et al.
2,922,169 A 1/1960 Werner
2,986,150 A 5/1961 Torian
2,992,441 A 7/1961 Landry
3,012,254 A 12/1961 Hamilton
3,018,493 A 1/1962 Wittbrodt
3,038,687 A 6/1962 Hartel
RE25,195 E 7/1962 Hamilton
3,044,078 A 7/1962 Hamilton
3,063,065 A 11/1962 Shaw
3,064,277 A 11/1962 Gill
3,092,847 A 6/1963 Puy
3,095,583 A 7/1963 Golub et al.
3,103,670 A 9/1963 Landry
3,120,368 A 2/1964 Crisp
3,158,876 A 12/1964 Gottlieb
3,162,865 A 12/1964 Tigrett
3,162,866 A 12/1964 Tigrett et al.
3,165,760 A 1/1965 Abajian
3,183,528 A 5/1965 Jacobs et al.
3,187,352 A 6/1965 Gottlieb
3,206,772 A 9/1965 Sarasin
3,222,841 A 12/1965 Lipof
3,233,254 A 2/1966 Golub et al.
3,289,986 A 12/1966 Martin
3,358,725 A 12/1967 Bussard et al.
3,546,721 A 12/1970 Clearly
3,640,576 A 2/1972 Morrison et al.
3,658,025 A 4/1972 Hood et al.
3,706,105 A 12/1972 Nicholas et al.
3,763,507 A 10/1973 Propst
3,837,019 A 9/1974 Hoff
3,875,623 A 4/1975 Johnston
3,886,607 A 6/1975 Dunn
3,996,650 A 12/1976 Tonn
4,008,497 A 2/1977 Badon
4,018,260 A 4/1977 Baslow
D244,890 S 7/1977 Adams
4,103,401 A 8/1978 Conley
4,105,244 A 8/1978 Colby
4,186,454 A 2/1980 Cone
D257,299 S 10/1980 Cone
4,302,048 A 11/1981 Yount
4,376,318 A 3/1983 Cirillo
4,447,026 A 5/1984 Maraghe
4,529,040 A 7/1985 Grollimund
4,538,309 A 9/1985 Gunter
4,561,138 A 12/1985 Hwang
4,573,224 A 3/1986 Saint
4,576,364 A 3/1986 O'Fearna
4,631,786 A 12/1986 Curry
4,651,367 A 3/1987 Osher et al.
4,819,285 A 4/1989 Fetters
4,848,843 A * 7/1989 Gibbs ..... A47C 3/00 297/440.22
4,878,322 A 11/1989 Ikeda et al.
4,899,496 A 2/1990 Chew, II
4,900,011 A 2/1990 Nolet
4,985,948 A 1/1991 Mariol
5,042,769 A 8/1991 Smed
5,140,718 A 8/1992 Toth
5,172,435 A 12/1992 Griffin et al.
5,197,154 A 3/1993 Shamie
5,211,498 A 5/1993 Huang
5,239,714 A 8/1993 Huang
D339,922 S 10/1993 Williams
D340,598 S 10/1993 Castiglioni et al.
5,274,863 A 1/1994 Fountain
5,279,006 A 1/1994 Teng
5,307,531 A 5/1994 Kao
5,335,685 A 8/1994 Dahulich
5,339,470 A 8/1994 Shamie
5,349,709 A 9/1994 Cheng
5,367,725 A 11/1994 Tsai
5,381,570 A 1/1995 Cheng
5,414,873 A 5/1995 Wolf
5,450,703 A 9/1995 Fuhrman et al.
5,504,951 A 4/1996 Yeh
5,513,399 A 5/1996 Weng
5,517,707 A 5/1996 LaMantia
5,526,542 A 6/1996 Huang
5,533,715 A 7/1996 Dandrea
5,545,151 A 8/1996 O'Connor et al.
5,553,336 A 9/1996 Mariol
5,560,055 A 10/1996 Ziegler
D375,217 S 11/1996 Rehmert
5,581,827 A 12/1996 Fong et al.
5,615,427 A 4/1997 Huang
D382,718 S 8/1997 Mariol
5,716,101 A 2/1998 Frinier et al.
5,722,477 A 3/1998 Richter et al.
5,752,297 A 5/1998 Ramey
5,758,868 A 6/1998 Shea
5,761,755 A 6/1998 Huang
5,762,403 A 6/1998 Robinson
5,778,465 A 7/1998 Myers
D397,882 S 9/1998 Wu
5,826,285 A 10/1998 Mariol et al.
5,845,349 A 12/1998 Tharalson et al.
5,867,850 A 2/1999 Mariol
5,867,851 A 2/1999 Mariol et al.
5,878,802 A 3/1999 Richter et al.
D409,411 S 5/1999 Mariol et al.
D411,386 S 6/1999 Horn
5,911,478 A * 6/1999 Goodman ..... A47C 7/22 297/440.11
5,918,329 A 7/1999 Huang
D413,025 S 8/1999 Mariol et al.
5,991,944 A 11/1999 Yang
5,992,348 A 11/1999 Harding
6,004,182 A 12/1999 Pasin
6,041,455 A 3/2000 Raffo et al.
6,067,676 A 5/2000 Carnahan et al.
6,076,448 A 6/2000 Rexroad
6,098,217 A 8/2000 Hammil
6,123,321 A 9/2000 Miller
6,148,488 A 11/2000 Gristock
6,173,462 B1 1/2001 Huang et al.
6,174,282 B1 1/2001 Tan
6,192,535 B1 2/2001 Warner et al.

(56) References Cited

U.S. PATENT DOCUMENTS 6,221,036 B1 4/2001 Lucas
6,233,759 B1 5/2001 Warner et al.
6,250,837 B1 6/2001 Mariol et al.
6,256,814 B1 7/2001 Drobinski
6,263,525 B1 7/2001 Liu
D448,218 S 9/2001 Celestina-Krevh
6,293,624 B1 9/2001 Gaylord et al.
6,317,907 B1 11/2001 Wang
6,332,231 B1 12/2001 Wang
6,385,800 B1 5/2002 Chen et al.
6,402,116 B1 6/2002 Northup
6,421,850 B1 7/2002 Welsh, Jr.
D461,645 S 8/2002 Hartenstine et al.
6,434,767 B1 8/2002 Welsh, Jr.
6,467,107 B1 10/2002 Glover et al.
6,510,570 B2 1/2003 Hartenstine et al.
6,539,563 B1 4/2003 Hsia
6,543,070 B2 4/2003 Longenecker et al.
6,550,083 B1 4/2003 LaMantia
6,560,827 B1 5/2003 Gross
6,578,211 B2 6/2003 Tharalson et al.
6,585,323 B2 * 7/2003 Gaylord ..... A47C 7/282 297/440.11
6,615,424 B1 9/2003 Chen et al.
6,665,895 B1 12/2003 St. Pierre et al.
6,721,971 B1 4/2004 Cheng
6,735,796 B2 5/2004 Warner, Jr. et al.
D494,393 S 8/2004 Chen
D500,213 S 12/2004 DeHart et al.
6,859,957 B1 3/2005 Chen
6,859,958 B2 3/2005 LaMantia
6,874,177 B2 4/2005 Hsia
6,895,611 B2 5/2005 Tharalson et al.
6,948,197 B1 9/2005 Chen
6,954,949 B1 10/2005 Chen
6,959,462 B2 11/2005 Chen
7,003,382 B2 2/2006 Honda
7,003,821 B2 2/2006 De Hart et al.
7,013,505 B2 3/2006 Martin
7,020,914 B2 4/2006 Miyakawa
7,043,779 B2 5/2006 Mendenhall et al.
7,055,192 B2 6/2006 Waters et al.
7,063,096 B2 6/2006 Stoeckler
7,090,201 B2 8/2006 Brucker
7,100,625 B2 9/2006 Valles
7,125,081 B2 * 10/2006 Church ..... B62B 9/00 297/440.11
D534,381 S 1/2007 Troutman et al.
D537,277 S 2/2007 Chen
D557,510 S 12/2007 Troutman
D566,998 S 4/2008 Troutman
D570,621 S 6/2008 Troutman et al.
D581,683 S 12/2008 Chen
7,458,114 B2 12/2008 Troutman
7,526,821 B2 * 5/2009 Chen ..... A47D 13/066 24/702
7,568,242 B2 8/2009 Troutman
7,568,243 B2 8/2009 Gehr et al.
D604,970 S 12/2009 Troutman et al.
D616,231 S 5/2010 Troutman et al.
D616,677 S 6/2010 Troutman et al.
7,740,320 B2 * 6/2010 Chiang ..... A47C 4/02 297/440.15
7,752,688 B2 * 7/2010 Chen ..... A47C 31/023 403/102
RE43,919 E 1/2013 Chen
8,490,227 B2 7/2013 Troutman
9,027,180 B2 5/2015 Troutman
9,149,128 B2 * 10/2015 Rampton ..... A47D 13/063
9,314,115 B2 4/2016 Troutman
9,848,714 B2 * 12/2017 Burns ..... A47D 13/063
2002/0084687 A1 * 7/2002 Gaylord ..... A47C 7/282 297/452.13
2003/0154547 A1 8/2003 Hsia
2003/0177575 A1 9/2003 Cheng et al.
2004/0261174 A1 12/2004 DeHart et al.
2005/0005353 A1 1/2005 Waldman et al.
2005/0120522 A1 * 6/2005 Church ..... B62B 9/00 24/265 R
2005/0144716 A1 7/2005 Chen
2005/0144717 A1 7/2005 Chen
2005/0144718 A1 7/2005 Miyakawa
2005/0229308 A1 10/2005 Chen
2005/0262629 A1 * 12/2005 Cheng ..... A47D 13/063 5/98.1
2006/0037137 A1 2/2006 Song
2006/0185082 A1 * 8/2006 Casati Troutman ..... A47D 13/063 5/99.1
2006/0225207 A1 10/2006 Johnson
2006/0230528 A1 10/2006 Church
2008/0034497 A1 2/2008 Cheng
2008/0115269 A1 * 5/2008 Chen ..... A47D 13/066 5/99.1
2009/0133190 A1 * 5/2009 Chen ..... A47C 31/023 5/93.1
2009/0260155 A1 * 10/2009 Troutman ..... A47D 13/063 5/98.1
2010/0109414 A1 * 5/2010 Chiang ..... A47C 4/02 297/440.11
2010/0132115 A1 * 6/2010 Hsu ..... A47D 13/063 5/98.1
2012/0012801 A1 * 1/2012 Burns ..... A47D 13/063 256/25
2012/0216346 A1 * 8/2012 Rampton ..... A47D 13/063 5/99.1
2013/0298326 A1 * 11/2013 Troutman ..... A47D 13/063 5/99.1
2015/0208822 A1 * 7/2015 Troutman ..... A47D 13/063 5/99.1
2016/0183697 A1 * 6/2016 Troutman ..... A47D 13/063 5/99.1

OTHER PUBLICATIONS

United States Patent and Trademark Office, "Order Granting Patent Owner's Motion to Seal and Granting Patent Owner's Motion for Entry of the Default Protective Order," issued in connection with Case No. IPR2016-00816 and Case No. IPR 2016-00826 on Oct. 16, 2017, 6 pages.

"Rule 131 Declartion of Damon Oliver Casati Troutman and Edward B. Bretschger," filed with the United States Patent and Trademark Office in connection with Case No. IPR2016-00816 and IPR2016-00826 on Jan. 3, 2017, 27 pages.

*Kolcraft Enterprises, Inc.* v. *Graco Children's Products Inc.*, "Defendant Graco Children's Products Inc.'s Motion for Leave to File Supplemental Reply in Support of Its Motion to Stay Pending Inter Partes Review," filed with the United States District Court for the Northern District of Illinois Eastern Division, case No. 1:15-CV-07950, filed Jun. 24, 2016, 66 pages.

*Kolcraft Enterprises, Inc.* v. *Graco Children's Products Inc.*, "Defendant Graco Children's Products Inc.'s Reply in Support of Its Motion for Leave Concerning Invalidity Contentions and Claim Construction," filed with the United States District Court for the Northern District of Illinois Eastern Division, case No. 1:15-CV-07950, filed Jun. 30, 2016, 104 pages.

"Patent Owner's Notice of Appeal," filed with the United States Patent and Trademark Office in connection with Case No. IPR2016-00352 on Aug. 2, 2017, 44 pages.

"Patent Owner's Motion to Seal," filed with the United States Patent and Trademark Office in connection with Case No. IPR2016-00816 on Jul. 21, 2017, 14 pages.

"Patent Owner's Motion to Seal," filed with the United States Patent and Trademark Office in connection with Case No. IPR2016-00826 on Jul. 21, 2017, 14 pages.

"Patent Owner's Motion to Seal, Redacted Exhibit 1024" filed with the United States Patent and Trademark Office in connection with Case No. IPR2016-00816 and Case No. IPR2016-00826 on Jul. 21, 2017, 97 pages.

(56) References Cited

OTHER PUBLICATIONS

"Patent Owner's Motion to Seal, Redacted Exhibit 1025" filed with the United States Patent and Trademark Office in connection with Case No. IPR2016-00816 and Case No. IPR2016-00826 on Jul. 21, 2017, 180 pages.
United States Patent and Trademark Office, "Record of Oral Hearing, Jul. 6, 2017," issued in connection with Case No. IPR2016-00816 and Case No. IPR 2016-00826 on Aug. 17, 2017, 61 pages.
*Kolcraft Enterprises, Inc.* v. *Graco Children's Products Inc.*, "Order," United States District Court for the Northern District of Illinois Eastern Division, case No. 1:15-CV-7950, entered Aug. 22, 2016, 5 pages.
*Kolcraft Enterprises, Inc.* v. *Graco Children's Products Inc.*, "Joint Status Report," filed with the United States District Court for the Northern District of Illinois Eastern Division, case No. 1:15-CV-07950, filed Oct. 24, 2016, 75 pages.
United States Patent and Trademark Office, "Decision Denying Institution of Inter Partes Review," issued in connection with Case No. IPR2016-00810, entered Sep. 28, 2016, 23 pages.
United States Patent and Trademark Office, "Decision: Institution of Inter Partes Review," issued in connection with Case No. IPR2016-00816 and Case No. IPR2016-00826, entered Oct. 3, 2016, 24 pages.
United States Patent and Trademark Office, "Decision: Institution of Inter Partes Review," issued in connection with Case No. IPR2016-00911 and Case No. IPR2016-00826, entered Oct. 17, 2016, 19 pages.
United States Patent and Trademark Office, "Judgment and Final Written Decision," issued in connection with Case No. IPR2016-00911 on Apr. 14, 2017, 3 pages.
United States Patent and Trademark Office, "Notice of Filing Date Accorded to Petition and Time for filing Patent Owner Preliminary Response," issued in connection with Case No. IPR2016-00352, mailed Dec. 31, 2015, 5 pages.
"Petition for Inter Partes Review of U.S. Pat. No. 9,027,180," filed with the United States Patent and Trademark Office on Dec. 16, 2015, 68 pages.
"Petition for Inter Partes Review of U.S. Pat. No. 9,027,180," Exhibit 1002, filed with the United States Patent and Trademark Office on Dec. 16, 2015, 53 pages.
"Petition for Inter Partes Review of U.S. Pat. No. 9,027,180," Exhibit 1014, filed with the United States Patent and Trademark Office on Dec. 16, 2015, 26 pages.
"Petition for Inter Partes Review of U.S. Pat. No. 9,027,180," Exhibit 1015, filed with the United States Patent and Trademark Office on Dec. 16, 2015, 30 pages.
"Petition for Inter Partes Review of U.S. Pat. No. 9,027,180," Exhibit 1016, filed with the United States Patent and Trademark Office on Dec. 16, 2015, 5 pages.
"Petition for Inter Partes Review of U.S. Pat. No. 9,027,180," Exhibit 1017, filed with the United States Patent and Trademark Office on Dec. 16, 2015, 4 pages.
"Petition for Inter Partes Review of U.S. Pat. No. 9,027,180," Exhibit 1018, filed with the United States Patent and Trademark Office on Dec. 16, 2015, 7 pages.
Office Action, issued by the United States Patent and Trademark Office dated Dec. 19, 2006, in connection with U.S. Appl. No. 11/101,822, 6 pages.
Office Action, issued by the United States Patent and Trademark Office dated Apr. 9, 2007, in connection with U.S. Appl. No. 11/101,822, 5 pages.
Office Action, issued by the United States Patent and Trademark Office dated Nov. 2, 2007, in connection with U.S. Appl. No. 11/101,822, 7 pages.
Notice of Allowance and Fee(s) Due, issued by the United States Patent and Trademark Office dated Jul. 31, 2008, in connection with U.S. Appl. No. 11/101,822, 4 pages.
Office Action, issued by the United States Patent and Trademark Office dated Aug. 21, 2006, in connection with U.S. Appl. No. 11/063,811, 19 pages.
Office Action, issued by the United States Patent and Trademark Office dated Jun. 5, 2007, in connection with U.S. Appl. No. 11/063,811, 13 pages.
Office Action, issued by the United States Patent and Trademark Office dated Mar. 5, 2008, in connection with U.S. Appl. No. 11/063,811, 16 pages.
Office Action, issued by the United States Patent and Trademark Office dated Oct. 30, 2008, in connection with U.S. Appl. No. 11/063,811, 13 pages.
Notice of Allowance and Fee(s) Due, issued by the United States Patent and Trademark Office dated Apr. 16, 2009, in connection with U.S. Appl. No. 11/063,811, 7 pages.
Office Action, issued by the United States Patent and Trademark Office dated Dec. 29, 2006, in connection with U.S. Appl. No. 11/101,821, 5 pages.
Office Action, issued by the United States Patent and Trademark Office dated May 22, 2007, in connection with U.S. Appl. No. 11/101,821, 13 pages.
Office Action, issued by the United States Patent and Trademark Office dated Jan. 23, 2008, in connection with U.S. Appl. No. 11/101,821, 16 pages.
Office Action, issued by the United States Patent and Trademark Office dated Feb. 4, 2008, in connection with U.S. Appl. No. 11/101,821, 16 pages.
Office Action, issued by the United States Patent and Trademark Office dated Nov. 23, 2005, in connection with U.S. Appl. No. 29/216,626, 6 pages.
Office Action, issued by the United States Patent and Trademark Office dated Apr. 21, 2006, in connection with U.S. Appl. No. 29/216,626, 7 pages.
Office Action, issued by the United States Patent and Trademark Office dated Nov. 14, 2005, in connection with U.S. Appl. No. 29/216,576, 4 pages.
Notice of Allowance and Fee(s) Due, issued by the United States Patent and Trademark Office dated Feb. 2, 2006, in connection with U.S. Appl. No. 29/216,576, 6 pages.
Notice of Allowance and Fee(s) Due, issued by the United States Patent and Trademark Office dated Dec. 28, 2007, in connection with U.S. Appl. No. 29/216,576, 13 pages.
Notice of Allowance and Fee(s) Due, issued by the United States Patent and Trademark Office dated Mar. 1, 2006, in connection with U.S. Appl. No. 29/244,887, 5 pages.
Notice of Allowance and Fee(s) Due, issued by the United States Patent and Trademark Office dated Sep. 26, 2007, in connection with U.S. Appl. No. 29/244,887, 5 pages.
Supplemental Notice of Allowance and Fee(s) Due, issued by the United States Patent and Trademark Office dated Oct. 19, 2007, in connection with U.S. Appl. No. 29/244,887, 2 pages.
Office Action, issued by the United States Patent and Trademark Office dated Nov. 14, 2005, in connection with U.S. Appl. No. 29/216,591, 4 pages.
Office Action, issued by the United States Patent and Trademark Office dated Jan. 30, 2006, in connection with U.S. Appl. No. 29/216,591, 4 pages.
Notice of Allowance and Fee(s) Due, issued by the United States Patent and Trademark Office dated Aug. 22, 2006, in connection with U.S. Appl. No. 29/216,591, 5 pages.
Office Action, issued by the United States Patent and Trademark Office on Mar. 2, 2006, in connection with U.S. Appl. No. 29/244,886, 7 pages.
Office Action, issued by the United States Patent and Trademark Office dated Jun. 27, 2006, in connection with U.S. Appl. No. 29/244,886, 5 pages.
Office Action, issued by the United States Patent and Trademark Office dated Jan. 26, 2007, in connection with U.S. Appl. No. 29/244,886, 5 pages.
Office Action, issued by the United States Patent and Trademark Office dated Nov. 20, 2007, in connection with U.S. Appl. No. 29/244,886, 5 pages.
Notice of Allowance and Fee(s) Due, issued by the United States Patent and Trademark Office dated Apr. 11, 2008, in connection with U.S. Appl. No. 29/244,886, 5 pages.

(56) References Cited

OTHER PUBLICATIONS

Supplemental Notice of Allowance and Fee(s) Due, issued by the United States Patent and Trademark Office dated Apr. 24, 2008, in connection with U.S. Appl. No. 29/244,886, 2 pages.
Office Action, issued by the United States Patent and Trademark Office dated Mar. 2, 2006, in connection with U.S. Appl. No. 29/244,885, 5 pages.
Office Action, issued by the United States Patent and Trademark Office dated Jun. 28, 2006, in connection with U.S. Appl. No. 29/244,885, 5 pages.
Office Action, issued by the United States Patent and Trademark Office dated Jan. 26, 2007, in connection with U.S. Appl. No. 29/244,885, 7 pages.
Examiner's Answer, issued by the United States Patent and Trademark Office dated Nov. 20, 2007, in connection with U.S. Appl. No. 29/244,885, 10 pages.
Decision on Appeal, issued by the United States Patent and Trademark Office on Sep. 25, 2009, in connection with U.S. Appl. No. 29/244,885, 12 pages.
Notice of Allowance and Fee(s) Due, issued by the United States Patent and Trademark Office dated Oct. 5, 2009, in connection with U.S. Appl. No. 29/244,885, 6 pages.
Office Action, issued by the United States Patent and Trademark Office dated Oct. 13, 2009, in connection with U.S. Appl. No. 29/339,831, 23 pages.
Notice of Allowance and Fee(s) Due, issued by the United States Patent and Trademark Office dated Mar. 10, 2010, in connection with U.S. Appl. No. 29/339,831, 5 pages.
Office Action, issued by the United States Patent and Trademark Office dated Oct. 13, 2009, in connection with U.S. Appl. No. 29/339,833, 20 pages.
Notice of Allowance and Fee(s) Due, issued by the United States Patent and Trademark Office dated Feb. 24, 2010, in connection with U.S. Appl. No. 29/339,833, 4 pages.
Office Action, issued by the United States Patent and Trademark Office dated Nov. 17, 2009, in connection with U.S. Appl. No. 12/494,932, 22 pages.
Office Action, issued by the United States Patent and Trademark Office dated Jun. 23, 2010, in connection with U.S. Appl. No. 12/494,932, 16 pages.
Office Action, issued by the United States Patent and Trademark Office dated Feb. 15, 2011, in connection with U.S. Appl. No. 12/494,932, 7 pages.
Office Action, issued by the United States Patent and Trademark Office dated Sep. 2, 2011, in connection with U.S. Appl. No. 12/494,932, 16 pages.
Office Action, issued by the United States Patent and Trademark Office dated Feb. 6, 2012, in connection with U.S. Appl. No. 12/494,932, 18 pages.
Office Action, issued by the United States Patent and Trademark Office dated May 21, 2012, in connection with U.S. Appl. No. 12/494,932, 15 pages.
Advisory Action, issued by the United States Patent and Trademark Office dated Aug. 24, 2012, in connection with U.S. Appl. No. 12/494,932, 4 pages.
Notice of Allowance, issued by the United States Patent and Trademark Office dated Mar. 25, 2013, in connection with U.S. Appl. No. 12/494,932, 17 pages.
Century Products Co. Instruction Manuel, "Fold-n-Go Care Center," 12 pages.
Jackson, Albert and David Day, Good Wood Joints, Popular Woodworking Books, F&W Publications, Inc., Cincinnati, OH, 1995, p. 11, ISBN 1-55870-539-2. (Book, copy not provided).
Trialanderror, "Round Mortise and Tenons," Febuary 20, 2012, available at http://trialanderrorwoodworker.wordpress.com/2012/02/20/round/mortice-and-tenons/, accessed on Sep. 22, 2014, 2 pages.
Applicant's Admitted Prior Art document, filed herewith, U.S. Appl. No. 13/947,864, Sep. 22, 2014 2pg.
Office Action, issued by the United States Patent and Trademark Office dated Oct. 16, 2013, in connection with U.S. Appl. No. 13/947,864 13 pages.
Office Action, issued by the United States Patent and Trademark Office dated Mar. 21, 2014, in connection with U.S. Appl. No. 13/947,864 24 pages.
Office Action, issued by the United States Patent and Trademark Office dated Nov. 18, 2014, in connection with U.S. Appl. No. 13/947,864 16 pages.
Notice of Allowance, issued by the United States Patent and Trademark Office dated Mar. 19, 2015, in connection with U.S. Appl. No. 13/947,864 12 pages.
United States Patent and Trademark Office, "Notice of Allowance," issued in connection with U.S. Appl. No. 14/677,579, dated Dec. 9, 2015, 14 pages.
United States Patent and Trademark Office, "Non-Final Office Action," issued in connection with U.S. Appl. No. 14/677,579, dated Oct. 23, 2015, 54 pages.
United States Patent and Trademark Office, "Notice of Allowability," issued in connection with U.S. Appl. No. 14/677,579, dated Jan. 15, 2016, 9 pages.
United States Patent and Trademark Office, "Notice of Allowability," issued in connection with U.S. Appl. No. 14/677,579, dated Mar. 15, 2016, 6 pages.
"Patent Owner's Manadatory Notices Pursuant to 37 C.F.R. §42.8(b)," filed with the United States Patent and Trademark Office in connection with Case No. IPR2016-00352 on May 6, 2016, 4 pages.
United States Patent and Trademark Office, "Decision Institution of Inter Partes Review 35 U.S.C. § 314(a) and 37 C.F.R. §42.108," issued in connection with Case No. IPR2016-00352, entered Jun. 23, 2016, 23 pages.
"Petition for Inter Partes Review of U.S. Pat. No. 7,458,411," filed with the United States Patent and Trademark Office on Apr. 18, 2016, 65 pages.
"Petition for Inter Partes Review of U.S. Pat. No. 7,458,411," Exhibit 1005, filed with the United States Patent and Trademark Office on Apr. 18, 2016, 62 pages.
"Petition for Inter Partes Review of U.S. Pat. No. 7,458,411," Exhibit 1013, filed with the United States Patent and Trademark Office on Apr. 18, 2016, 3 pages.
"Petition for Inter Partes Review of U.S. Pat. No. 7,458,411," Exhibit 1014, filed with the United States Patent and Trademark Office on Apr. 18, 2016, 1 page.
United States Patent and Trademark Office, "Notice of Filing Date Accorded to Petition and Time for filing Patent Owner Preliminary Response," issued in connection with Case No. IPR2016-00911, mailed Apr. 21, 2016, 4 pages.
"Patent Owner's Manadatory Notices Pursuant to 37 C.F.R. §42.8(b)," filed with the United States Patent and Trademark Office in connection with Case No. IPR2016-00911 on May 6, 2016, 4 pages.
"Petition for Inter Partes Review of U.S. Pat. No. D570,621," filed with the United States Patent and Trademark office on Mar. 29, 2016, 69 pages.
"Petition for Inter Partes Review of U.S. Pat. No. D570,621," Exhibit 1002, filed with the United States Patent and Trademark Office on Mar. 29, 2016, 119 pages.
"Petition for Inter Partes Review of U.S. Pat. No. D570,621," Exhibit 1004, filed with the United States Patent and Trademark Office on Mar. 29, 2016, 16 pages.
"Petition for Inter Partes Review of U.S. Pat. No. D570,621," Exhibit 1011, filed with the United States Patent and Trademark Office on Mar. 29, 2016, 1 page.
"Petition for Inter Partes Review of U.S. Pat. No. D570,621," Exhibit 1015, filed with the United States Patent and Trademark Office on Mar. 29, 2016, 14 pages.
"Petition for Inter Partes Review of U.S. Pat. No. D570,621," Exhibit 1016, filed with the United States Patent and Trademark Office on Mar. 29, 2016, 2 pages.
United States Patent and Trademark Office, "Notice of Filing Date Accorded to Petition and Time for filing Patent Owner Preliminary Response," issued in connection with Case No. IPR2016-00810, mailed Mar. 31, 2016, 5 pages.

(56) References Cited

OTHER PUBLICATIONS

"Patent Owner's Manadatory Notices Pursuant to 37 C.F.R. §42. 8(b)," filed with the United States Patent and Trademark Office in connection with Case No. IPR2016-00810 on Apr. 19, 2016, 4 pages.
"Petition for Inter Partes Review of U.S. Pat. No. D604,970," filed with the United States Patent and Trademark office on Mar. 30, 2016, 57 pages.
"Petition for Inter Partes Review of U.S. Pat. No. D604,970," Exhibit 1002, filed with the United States Patent and Trademark Office on Mar. 30, 2016, 101 pages.
United States Patent and Trademark Office, "Notice of Filing Date Accorded to Petition and Time for filing Patent Owner Preliminary Response," issued in connection with Case No. IPR2016-00816, mailed Apr. 4, 2016, 3 pages.
"Patent Owner's Manadatory Notices Pursuant to 37 C.F.R. §42. 8(b)," filed with the United States Patent and Trademark Office in connection with Case No. IPR2016-00826 on Apr. 19, 2016, 4 pages.
"Petition for Inter Partes Review of U.S. Pat. No. D616,231," filed with the United States Patent and Trademark office on Mar. 31, 2016, 59 pages.
"Petition for Inter Partes Review of U.S. Pat. No. D616,231," Exhibit 1002, filed with the United States Patent and Trademark Office on Mar. 31, 2016, 102 pages.
United States Patent and Trademark Office, "Notice of Filing Date Accorded to Petition and Time for filing Patent Owner Preliminary Response," issued in connection with Case. No. IPR2016-00826, mailed Apr. 7, 2016, 4 pages.
"Patent Owner's Mandatory Notices Pursuant to 37 C.F.R. §42. 8(b)," filed with the United States Patent and Trademark Office in connection with Case No. IPR2016-0026 on Apr. 19, 2016, 4 pages.
*Kolcraft Enterprises, Inc.* v. *Graco Children's Products Inc.*, "Complaint for Patent Infringement," filed with the United States District Court for the Northern District of Illinois Eastern Division, case No. 1:15-CV-07950, filed Sep. 9, 2015, 20 pages.
*Kolcraft Enterprises, Inc.* v. *Graco Children's Products Inc.*, "Answer to Complaint," filed with the United States District Court for the Northern District of Illinois Eastern Division, case No. 1:15-CV-07950, filed Oct. 13, 2015, 24 pages.
*Kolcraft Enterprises, Inc.* v. *Graco Children's Products Inc.*, "Amended Answer to Complaint and Counterclaim," filed with the United States District Court for the Northern District of Illinois Eastern Division, case No. 1:15-CV-07950, filed Mar. 7, 2016, 36 pages.
*Kolcraft Enterprises, Inc.* v. *Graco Children's Products Inc.*, "Plaintiff's Response to Defandant's Counterclaims," filed with the United States District Court for the Northern District of Illinois Eastern Division, case No. 1:15-CV-07950, filed Mar. 21, 2016, 17 pages.
*Kolcraft Enterprises, Inc.* v. *Graco Children's Products Inc.*, "Defendant Graco Children's Products Inc.'s Memorandum of Law in Support of Motion for Leave to Amend Its Invalidity Contentions and to Rely on More Than Twenty-Five Prior Art References," filed with the United States District Court for the Northern District of Illinois Eastern Division, case No. 1:15-CV-07950, filed Jun. 10, 2016, 11 pages.
*Kolcraft Enterprises, Inc.* v. *Graco Children's Products Inc.*, "Defendant Graco Children's Products Inc.'s Memorandum of Law in Support of Motion for Leave to Amend Its Invalidity Contentions and to Rely on More Than Twenty-Five Prior Art References: Exhibit A," filed with the United States District Court for the Northern District of Illinois Eastern Division, case No. 1:15-CV-07950, filed Jun. 10, 2016, 50 pages.
*Kolcraft Enterprises, Inc.* v. *Graco Children's Products Inc.*, "Defendant Graco Children's Products Inc.'s Memorandum of Law in Support of Motion for Leave to Amend Its Invalidity Contentions and to Rely on More Than Twenty-Five Prior Art References: Exhibit B," filed with the United States District Court for the Northern District of Illinois Eastern Division, case No. 1:15-CV-07950, filed Jun. 10, 2016, 39 pages.
*Kolcraft Enterprises, Inc.* v. *Graco Children's Products Inc.*, "Defendant Graco Children's Products Inc.'s Memorandum of Law in Support of Motion for Leave to Amend Its Invalidity Contentions and to Rely on More Than Twenty-Five Prior Art References: Exhibit C," filed with the United States District Court for the Northern District of Illinois Eastern Division, case No. 1:15-CV-07950, filed Jun. 10, 2016, 19 pages.
*Kolcraft Enterprises, Inc.* v. *Graco Children's Products Inc.*, "Defendant Graco Children's Products Inc.'s Memorandum of Law in Support of Motion for Leave to Amend Its Invalidity Contentions and to Rely on More Than Twenty-Five Prior Art References: Exhibit D," filed with the United States District Court for the Northern District of Illinois Eastern Division, case No. 1:15-CV-07950, filed Jun. 10, 2016, 11 pages.
*Kolcraft Enterprises, Inc.* v. *Graco Children's Products Inc.*, "Defendant Graco Children's Products Inc.'s Memorandum of Law in Support of Motion for Leave to Amend Its Invalidity Contentions and to Rely on More Than Twenty-Five Prior Art References: Exhibit E," filed with the United States District Court for the Northern District of Illinois Eastern Division, case No. 1:15-CV-07950, filed Jun. 10, 2016, 99 pages.
*Kolcraft Enterprises, Inc.* v. *Graco Children's Products Inc.*, "Defendant Graco Children's Products Inc.'s Memorandum of Law in Support of Motion for Leave to Amend Its Invalidity Contentions and to Rely on More Than Twenty-Five Prior Art References: Exhibit F," filed with the United States District Court for the Northern District of Illinois Eastern Division, case No. 1:15-CV-07950, filed Jun. 10, 2016, 320 pages.
*Kolcraft Enterprises, Inc.* v. *Graco Children's Products Inc.*, "Defendant Graco Children's Products Inc.'s Memorandum of Law in Support of Motion for Leave to Amend Its Invalidity Contentions and to Rely on More Than Twenty-Five Prior Art References: Exhibit G," filed with the United States District Court for the Northern District of Illinois Eastern Division, case No. 1:15-CV-07950, filed Jun. 10, 2016, 16 pages.
*Kolcraft Enterprises, Inc.* v. *Graco Children's Products Inc.*, "Defendant's Motion for Leave to Present More Than Ten Terms or Phrases for Construction by the Court and for Additional Pages for Claim Construction Briefing," filed with the United States District Court for the Northern District of Illinois Eastern Division, case No. 1:15-CV-07950, filed Jun. 13, 2016, 18 pages.
*Kolcraft Enterprises, Inc.* v. *Graco Children's Products Inc.*, "Plaintiff's Response to Defendant's Motions Concerning Invalidity Contentions (Dkt. #35) and Claim Construction (#38)," Filed with the United States District Court for the Northern District of Illinois Eastern Division, case No. 1:15-CV-07950, filed Jun. 15, 2016, 67 pages.
*Kolcraft Enterprises, Inc.* v. *Thorely Industries LLC d/b/a 4MOMS*, "Complaint for Patent Infringement," filed with the United States District Court for the Northern District of Illinois Eastern Division, case No. 1:15-CV-07954, filed Sep. 9, 2015, 5 pages.
*Kolcraft Enterprises, Inc.* v. *Thorely Industries LLC d/b/a 4MOMS*, "Answer for Complaint to Patent Infringement," filed with the United States District Court for the Northern District of Illinois Eastern Division, case No. 1:15-CV-07954, filed Nov. 12, 2015, 9 pages.
*Kolcraft Enterprises, Inc.* v. *Thorely Industries LLC d/b/a 4MOMS*, "Plaintiff's Response to Defendant's Counterclaims," filed with the United States District Court for the Northern District of Illinois Eastern Division, case No. 1:15-CV-07954, filed Dec. 1, 2015, 6 pages.
Century Products Co. Instruction Manuel, "Fold-n-Go Lullaby Center," (Jun. 2006) , 12 pages.
Graco, "Owners Manual" (2014), 58 pages.
Graco, "Owners Manual" (2013), 38 pages.
*Kolcraft Enterprises, Inc.* v. *Graco Children's Products, Inc.*, "Reply Brief of Appellant Kolcraft Enterprises, Inc.," filed with the United States Court of Appeals for the Federal Circuit, case Nos. 18-1259 and 18-1260, dated Jun. 12, 2018, 25 pages.
*Kolcraft Enterprises, Inc.* v. *Graco Children's Products, Inc.*, "Non-Confidential Joint Appendix, vol. I," filed with the United States Court of Appeals for the Federal Circuit, case Nos. 18-1259 and 18-1260, on Jun. 19, 2018, 613 pages. (Submitted as 2 parts).

(56) References Cited

OTHER PUBLICATIONS

*Kolcraft Enterprises, Inc.* v. *Graco Children's Products, Inc.*, "Non-Confidential Joint Appendix, vol. II," filed with the United States Court of Appeals for the Federal Circuit, case Nos. 18-1259 and 18-1260, on Jun. 19, 2018, 304 pages.
*Kolcraft Enterprises, Inc.* v. *Graco Children's Products, Inc.*, "Joint Statement of Compliance with Federal Circuit Rule 33(a)," filed with the United States Court of Appeals for the Federal Circuit, case Nos. 18-1259 and 18-1260, on Jun. 19, 2018, 3 pages.
Arizona Department of Homeland Security, Arizona Citizen Corps Program, "During an Emergency—Weather: Extreme Temperatures," available at http://www.azdohs.gov/ASCCC/ER/ProEmerg_WeatherET.asp (last accessed Sep. 21, 2016), 2 pages.
Plastics International, "PVC (Polyvinyl Chloride)," available at http://www.plasticsintl.com/datasheets/PVC.pdf (last accessed Sep. 21, 2016), 1 page.
*Kolcraft Enterprises, Inc.* v. *Thorley Industries LLC,* "Joint Stipulation of Dismissal of Plaintiff's Claims and Defendant's Counterclaims with Prejudice," filed with the United States District Court for the Northern District of Illinois Eastern Division, case No. 1:15-CV-07954, filed Dec. 15, 2017, 2 pages.
*Kolcraft Enterprises, Inc.* v. *Thorley Industries LLC*, "Notification of Docket Entry," issued by the United States District Court for the Northern District of Illinois Eastern Division, case No. 1:15-CV-07954, filed Dec. 18, 2017, 1 page.
"Patent Owner's Notice of Appeal," filed with the United States Patent and Trademark Office in connection with Case No. IPR2016-00816 on Dec. 4, 2017, 28 pages.
"Patent Owner's Notice of Appeal," filed with the United States Patent and Trademark Office in connection with Case No. IPR2016-00826 on Dec. 4, 2017, 28 pages.
*Kolcraft Enterprises, Inc.* v. *Thorley Industries LLC*, "Joint Stipulation of Voluntary Dismissal," filed with the United States Court of Appeals for the Federal Circuit, case No. 17-2382, filed Dec. 15, 2017, 3 pages.
"Patent Owner's Updated Manadatory Notices Pursuant to 37 C.F.R. §42.8(b)," filed with the United States Patent and Trademark Office in connection with Case No. IPR2016-00826 on Mar. 15, 2017, 4 pages.
"Patent Owner's Updated Manadatory Notices Pursuant to 37 C.F.R. §42.8(b)," filed with the United States Patent and Trademark Office in connection with Case No. IPR2016-00816 on Mar. 15, 2017, 4 pages.
*Kolcraft Enterprises, Inc.* v. *Thorley Industries LLC*, "Unopposed Motion for Voluntary Dismissal," filed with the United States Court of Appeals for the Federal Circuit, case No. 17-2382, filed Dec. 27, 2017, 5 pages.
*Kolcraft Enterprises, Inc.* v. *Thorley Industries LLC*, "Order," issued by the United States Court of Appeals for the Federal Circuit, case No. 17-2382, on Dec. 28, 2017, 2 pages.
*Kolcraft Enterprises, Inc.* v. *Graco Children's Products, Inc.*, "Non-Confidential Brief of Appellant Kolcraft Enterprises, Inc.," filed with the United States Court of Appeals for the Federal Circuit, case Nos. 18-1259 and 18-1260, on Mar. 19, 2018, 108 pages (includes Appendix).
*Kolcraft Enterprises, Inc.* v. *Graco Children's Products Inc.*, "Brief of Appellee Graco Children's Products Inc.," filed with the United States Court of Appeals for the Federal Circuit, case Nos. 18-1259 and 18-1260, on May 14, 2018, 66 pages.
United States Patent and Trademark Office, "Final Written Decision," issued in connection with Case No. IPR2016-00352 on Jun. 1, 2017, 36 pages.
*Kolcraft Enterprises, Inc.* v. *Graco Children's Products, Inc.*, "Joint Status Report," filed with the United States District Court for the Northern District of Illinois Eastern Division, case No. 1:15-CV-07950, on Oct. 19, 2018, 206 pages.
*Kolcraft Enterprises, Inc.* v. *Graco Children's Products, Inc.*, "Supplemental Joint Status Report," filed with the United States District Court for the Northern District of Illinois Eastern Division, case No. 1:15-CV-07950, on Oct. 31, 2018, 3 pages.
*Kolcraft Enterprises, Inc.* v. *Thorley Industries LLC*, "Notification of Docket Entry," issued by the United States District Court for the Northern District of Illinois Eastern Division, case No. 1:15-CV-07950, filed Jan. 7, 2019, 1 page.
United State Court of Appeals for the Federal Circuit, "Opinion", issued in connection wth case Nos. 2018-1259 and 2018-1260, Jul. 2, 2019, 10 pages.
United State Court of Appeals for the Federal Circuit, "Judgment", issued in connection wth case Nos. 2018-1259 and 2018-1260, Jul. 2, 2019, 1 page.
*Kolcraft Enterprises, Inc.* v. *Graco Children's Products, Inc.*, "Joint Status Report," filed with the United States District Court for the Northern District of Illinois Eastern Division, case No. 1:15-CV-07950, on Jul. 9, 2019, 17 pages.
*Kolcraft Enterprises, Inc.* v. *Graco Children's Products, Inc.*, "Notification of Docket Entery," issued by the United States District Court for the Northern District of Illinois Eastern Division, case No. 1:15-CV-07950, on Jul. 22, 2019, 1 page.
*Kolcraft Enterprises, Inc.* v. *Graco Children's Products, Inc.*, "Revised Discovery Plan," filed with the United States District Court for the Northern District of Illinois Eastern Division, case No. 1:15-CV-07950, on Aug. 5, 2019, 8 pages.
*Kolcraft Enterprises, Inc.* v. *Graco Children's Products, Inc.*, "Notification of Docket Entery," issued by the United States District Court for the Northern District of Illinois Eastern Division, case No. 1:15-CV-07950, on Aug. 26, 2019, 1 page.

* cited by examiner

PLAY YARDS AND METHODS OF OPERATING THE SAME

RELATED APPLICATIONS

This patent arises from a continuation of U.S. patent application Ser. No. 14/677,579 (now U.S. Pat. No. 9,314,115), which was filed on Apr. 2, 2015, which is a continuation of U.S. patent application Ser. No. 13/947,864 (now U.S. Pat. No. 9,027,180), which was filed on Jul. 22, 2013, which is a continuation of U.S. patent application Ser. No. 12/494,932 (now U.S. Pat. No. 8,490,227), which was filed on Jun. 30, 2009, which is a continuation of U.S. patent application Ser. No. 11/063,811 (now U.S. Pat. No. 7,568,242), which was filed on Feb. 23, 2005. Priority to U.S. patent application Ser. Nos. 14/677,579; 13/947,864; 12/494,932; and 11/063,811 is claimed. U.S. patent application Ser. Nos. 14/677,579; 13/947,864; 12/494,932; and 11/063,811 are hereby incorporated by reference in their entireties.

FIELD OF THE DISCLOSURE

This disclosure relates generally to childcare products, and, more particularly, to play yards and methods of operating the same.

BACKGROUND

In recent years, portable play yards have become very popular. Portable play yards typically include a frame, a flexible enclosure supported by the frame, and a removable floor board or mat. The frame is largely or completely contained within the flexible enclosure so that there are few if any loose parts when the frame is collapsed or when the frame is erected. When collapsed, the portable play yard typically has a compact form factor to enable easy transport and storage of the play yard. Sometimes, the floorboard is wrapped around the collapsed frame to prevent the frame from inadvertently leaving the collapsed state.

DETAILED DESCRIPTION

Figure 1:
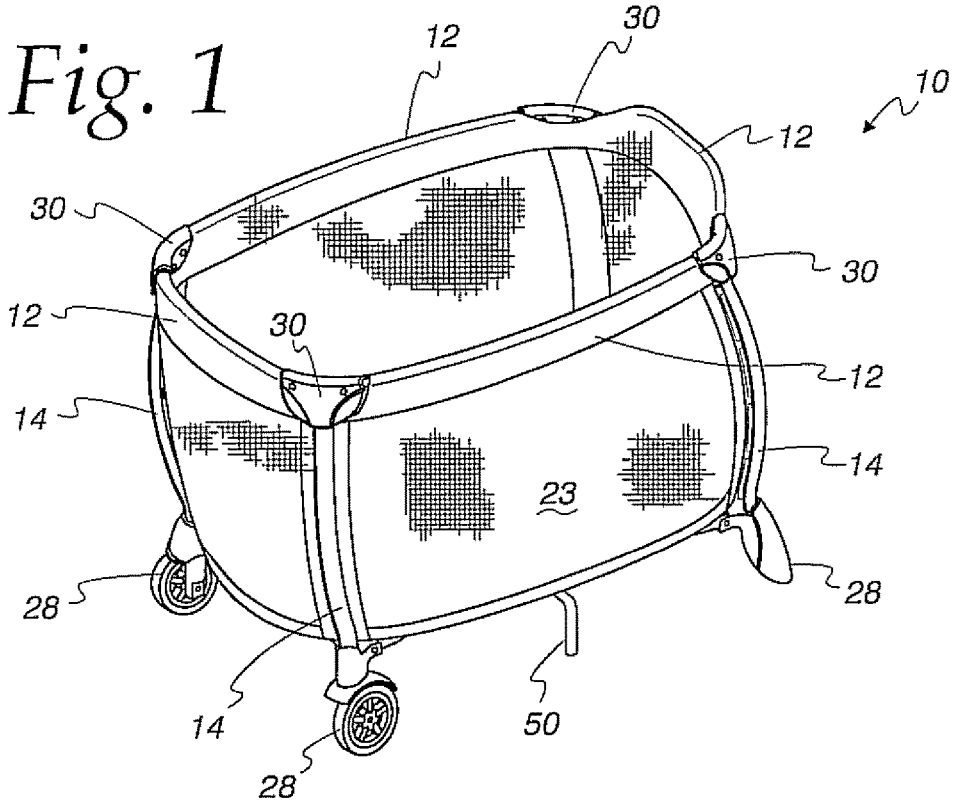
FIG. 1 is a perspective view of an example play yard constructed in accordance with the teachings of the invention.

An example play yard 10 is shown in FIG. 1. The play yard 10 is portable in that it is intended to be collapsible from an erected position such as the example position shown in FIG. 1 to a collapsed position such as the example position illustrated in FIGS. 6-7. When the play yard 10 is in the erected position, it provides an enclosure for a small child or infant. The play yard 10 has a smaller form factor when it is in the collapsed position then when it is in the erected position. Therefore, the play yard 10 may be easily stored or transported when collapsed.

As shown in FIG. 1, when in the erected position, the illustrated play yard 10 has a rounded rectangular shape. In particular, the illustrated play yard 10 has four sides 12, each of which is bowed outward away from the center of the play yard 10. In addition, the play yard 10 of FIG. 1 includes four corner posts 14 joining the sides 12 that define the rounded rectangular shape. Like the sides 12, the corner posts 14 are bowed outward away from the center of the play yard 10. However, whereas the sides 12 bow about a generally vertical axis, the corner posts 14 curve about a generally horizontal axis. As a result of the bowed sides 12 and corner posts 14, the play yard 10 defines a rounded rectangular volume.

Figure 2:
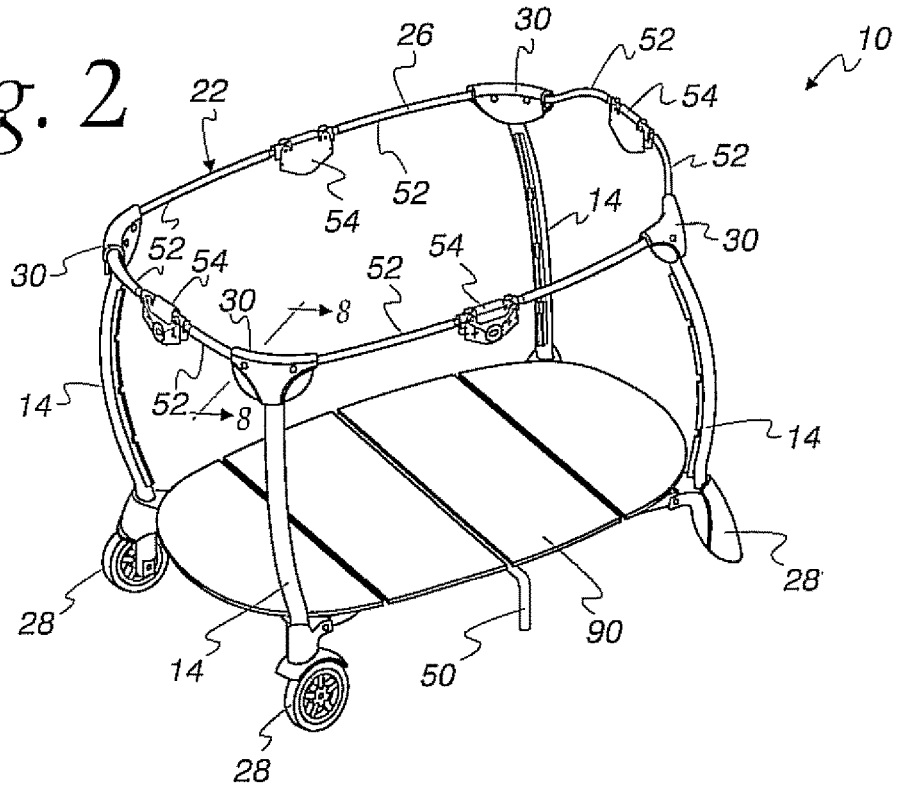
FIG. 2 is a perspective view of the example play yard of FIG. 1 shown without the enclosure.
Figure 3:
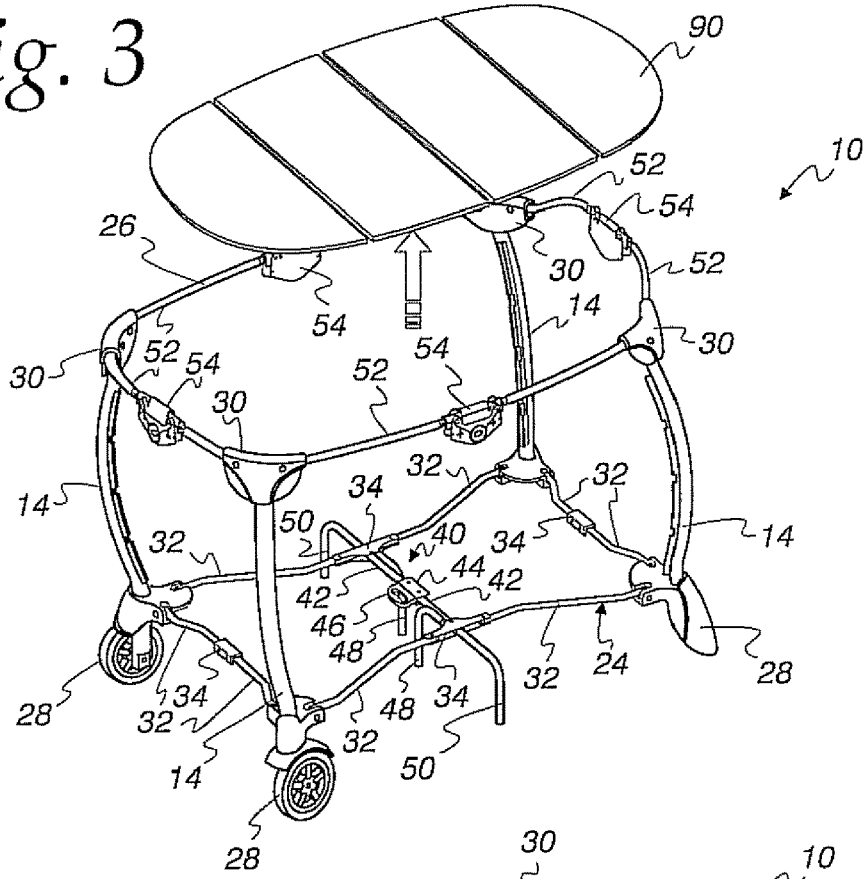
FIG. 3 illustrates the example play yard of FIG. 1 with the removable floor board raised to expose the lower frame.

The illustrated portable play yard 10 includes a frame 22 (see FIGS. 2 and 3) and an enclosure 23 supported on the frame 22. The frame 22 includes a collapsible lower frame 24 (see FIG. 3) and a collapsible upper frame 26 (see FIG. 2). The upper frame 26 is suspended above the lower frame 24 by the corner posts 14. Each of the corner posts 14 is connected between a foot 28 and an end cap or bracket 30. Each foot 28 is coupled to the lower frame 24. Each end cap 30 is coupled to the upper frame 26.

As shown in FIG. 1, in the illustrated play yard 10 two of the feet are implemented as conventional wheels and two of the feet 28 are implemented as stationary supports to facilitate movement of the erected play yard 10 when desired and to prevent unwanted rolling of the play yard 10 when movement is not desired. However, persons of ordinary skill in the art will appreciate that a different number of feet 28 (e.g., 0, 1, etc.) may be implemented by wheels and/or stationary supports, if desired.

Figure 4:
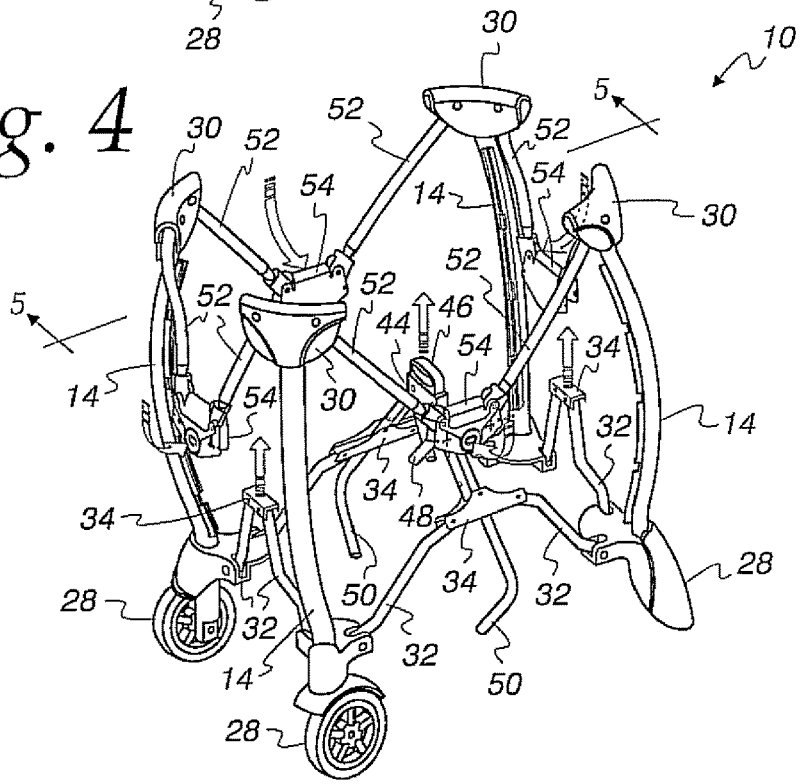
FIG. 4 illustrates the example play yard of FIG. 1 in a semi-folded state with arrows indicating the direction in which the joints of the frame of the play yard move to collapse the play yard.
Figure 5:
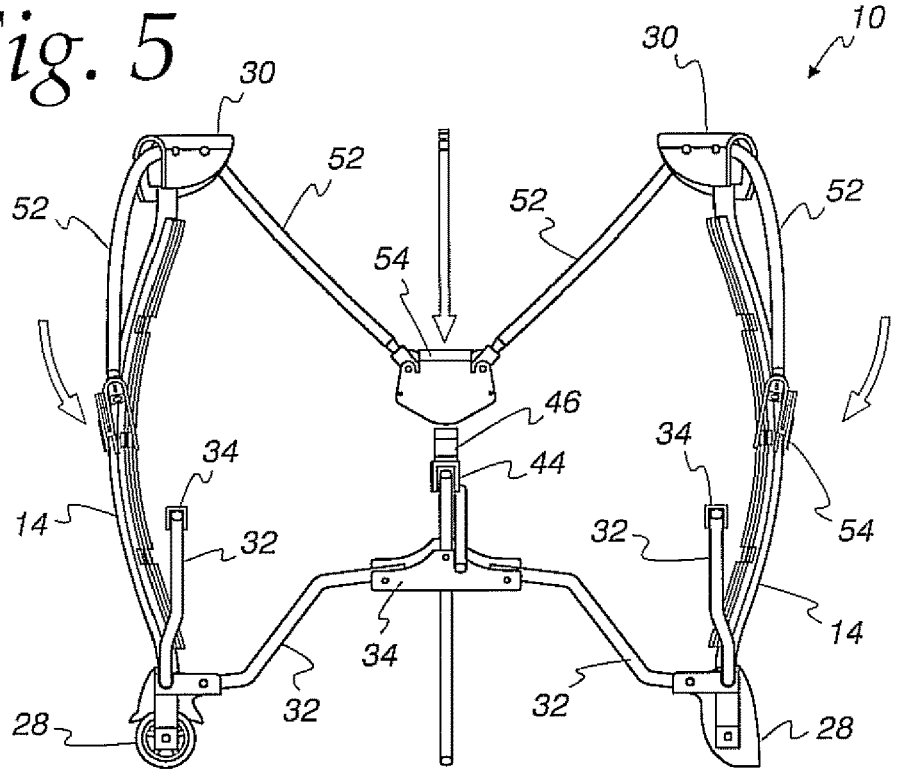
FIG. 5 is a side view of the example play yard of FIG. 1 in a semi-folded state.

The lower frame 24 of the illustrated play yard 10 includes four outer sides which, when the lower frame is in the erected position, together define a generally rectangular perimeter. Each of the outer sides comprises a pair of rails 32 joined by a central joint 34. One end of each of the rails 32 is pivotably coupled to one of the feet 28. The opposite end of each of the rails 32 is pivotably coupled to one of the central joints 34. The pivotable couplings enable the sides of the lower frame 24 to be moved between the erected position and the collapsed position. As shown in FIGS. 4 and 5, the joints 34 move upward and translate inward when the play yard 10 is moved from the erected position to the collapsed position.

For the purpose of selectively locking the lower frame 24 in the erected position and for providing support for the center of the play yard 10, the lower frame 10 is further provided with a central assembly 40. The central assembly 40 is pivotably coupled to the central joints 34 of two opposite sides of the lower frame 24. More specifically, the central assembly 40 includes two rails 42 and a central hinge 44. In the illustrated example, one end of each rail 42 is pivotably coupled to a respective one of the central joints 34 of the long sides of the play yard 10. The opposite ends of the rails 42 are coupled to the central hinge 44 of the central assembly 40.

The central hinge 44 includes a conventional lock mechanism to selectively permit or prevent movement of the central assembly 40 and, thus, the lower frame assembly 24 from the erected position to the collapsed position. The lock mechanism comprises a handle 46. When the handle 46 is pivoted into a generally horizontal position (see FIG. 3), a sleeve associated with the handle 46 substantially prevents the rails 42 of the central assembly 40 from pivoting upward. As a result, the central assembly 40 and, thus, the lower frame 24 cannot be collapsed. When the handle 46 is pivoted into a generally vertical position (See FIG. 4), the sleeve associated with the handle 46 does not prevent the rails 44 of the central assembly 40 from pivoting upward. As a result, the central assembly 40 and, thus, the lower frame 24 may be collapsed by lifting the handle 46.

To provide support for the center of the play yard floor when the play yard 10 is in the erected position, the central assembly 40 includes a pair of centrally located feet 48. To provide further lateral support for the lower frame 24, a pair of opposed outrigger feet 50 are coupled to opposed ones of the central hinges 34 (see FIGS. 3 and 4). Like the feet 28, the outrigger feet 50 and the centrally located feet 48 are positioned to engage a ground surface supporting the play yard 10 when the play yard 10 is in the erected position.

The upper frame 26 of the illustrated play yard 10 includes four outer sides which, when the upper frame 26 is in the erected position, together define a rounded rectangular (i.e., four sided) perimeter. The rounded rectangular shape may be an oval, a half-oval, or any combination of rounded and straight sides. However, at least one of the sides is preferably rounded. It is even more preferable that at least two opposite sides are rounded to provide symmetry.

In the illustrated example, each of the outer sides comprises a pair of outwardly bowed rails 52 joined by a central joint 54. One end of each of the rails 52 is pivotably coupled to one of the end caps 30. The opposite end of each of the rails 52 is pivotably coupled to one of the central joints 54. The pivotable couplings enable the sides of the upper frame 26 to be moved between the erected position and the collapsed position.

Each of the central joints 54 is provided with a releasable lock to enable selective collapsing of the upper frame 26. The construction of the releasable lock forms no part of the present invention and will not be discussed in detail here. Persons of ordinary skill in the art are aware of the numerous types of joint locks that are used in portable play yards. Any of those known locks may be employed in the illustrated play yard 10. For example, the releasable locks described in U.S. Pat. No. 6,250,837, which is hereby incorporated herein by reference, may be used in this role.

Figure 6:
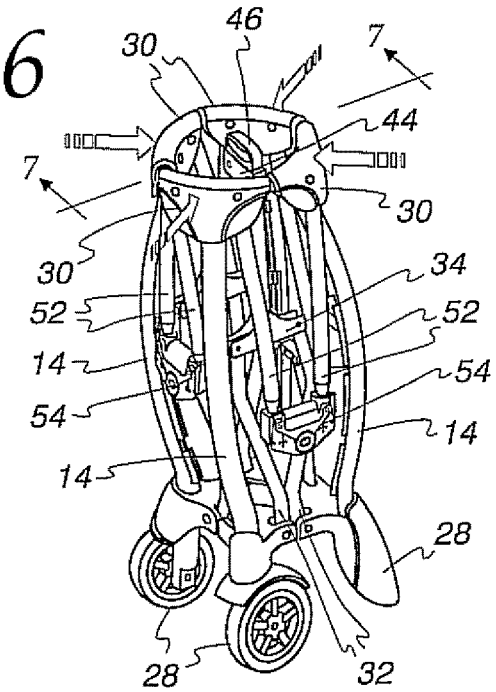
FIG. 6 is a perspective view of the example play yard of FIG. 1 in a fully folded state.
Figure 7:
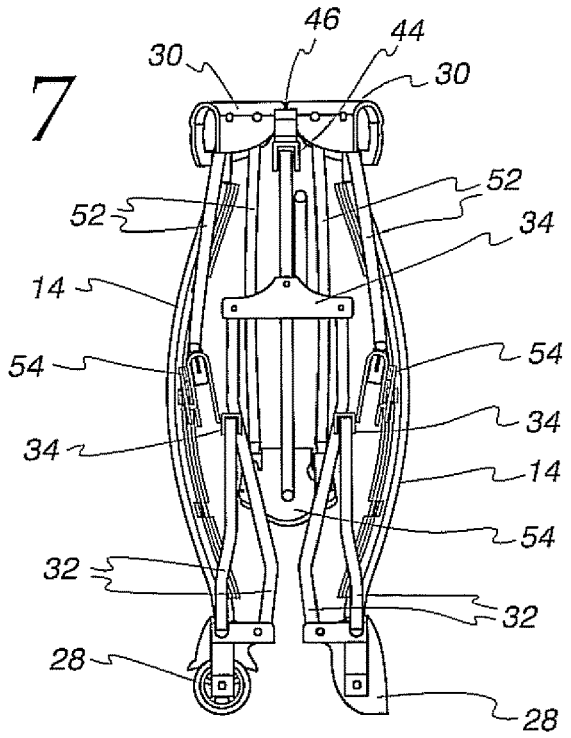
FIG. 7 is side view of the example play yard of FIG. 1 in the fully folded state.

It is desirable for the form factor of the play yard 10 to be as small as possible when the play yard 10 is folded into the collapsed position of FIG. 6. A small form factor translates into less packaging costs for the manufacturer and smaller storage requirements for the end user. Because the rails 52 of the upper frame 26 are outwardly bowed to create the rounded rectangular perimeter, the central joints 54 extend further away from the center of the play yard 10 when the upper frame 26 is in the erected position than would the central joints of a conventional rectangular frame. Therefore, if the central joints 54 are permitted to move directly downward when the upper frame 24 is moved from the erected position to the collapsed position, the joints 54 would increase the form factor of the collapsed play yard 10.

Therefore, to reduce the form factor of the collapsed play yard 10, the rails 52 of the upper frame 26 are coupled to the end caps 30 such that the centers of each side of the upper frame 26 (e.g., the central joints 54) move inward and downward as the upper frame 26 moves from the erected position to the collapsed position, as indicated by the arrows in FIGS. 4 and 5. (The inward component of this motion is in addition to the inward translation caused by moving the posts 14 toward one another as shown in FIG. 6). As a result, when the upper and lower frames 24, 26 are in the collapsed positions shown in FIG. 6, the joints 54 are positioned inward of the posts 14. Positioning the joints 54 inward of the posts 14 when the play yard 10 is in the fully collapsed position creates a smaller, more compact structure, which eases storage and transportation.

Figure 8:
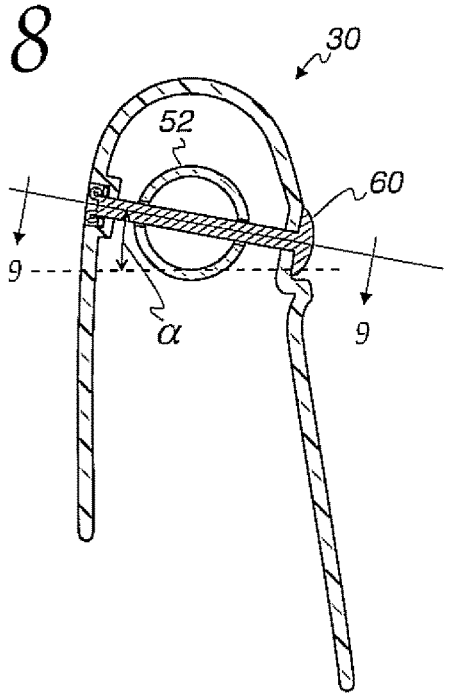
FIG. 8 is a cross-sectional view of an end cap of the example play yard taken along line 8-8 of FIG. 1 and illustrating the pivotable connection of an upper frame rail to the end cap.
Figure 9:
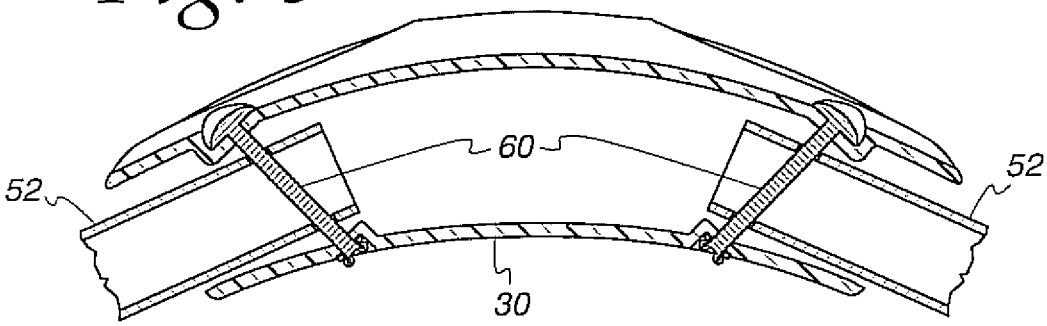
FIG. 9 is a cross-sectional view taken along line 9-9 of FIG. 8.

To produce the desired inward and downward movement of the centers of the rails 52 as the upper frame 26 is collapsed, the rails 52 of the upper frame 26 are pivotably coupled to the end caps 30 by mechanical fasteners 60 that are positioned at an angle $\alpha$ from the horizontal. In the example of FIGS. 8 and 9, each mechanical fastener 60 penetrates an end cap 30 and a corresponding one of the rails 52 of the upper frame 26. Each mechanical fastener 60, thus, defines an axis of rotation for a corresponding one of the rails 52. Selecting the angular orientation of the mechanical fasteners 60, thus selects the pivoting motion of the corresponding rails 52.

Preferably, all of the mechanical fasteners 60 are positioned at the same angle $\alpha$, but persons of ordinary skill in the art will readily appreciate that different angular orientations could optionally be used for different sides of the upper frame 26 if different pivoting motions are desired for those different sides. For example, if it is desirable to have sides that extend different distances from the center of the play yard when the play yard is erected, but which still close in to substantially the same distance from the center of the play yard when the play yard is collapsed such that the collapsed play yard has a generally rectangular form factor, the fasteners of the differently positioned sides would be positioned at different angular orientations to achieve the different movements of the differently extending sides. Similarly, in the illustrated example, the angle $\alpha$ is approximately 11 degrees from the horizontal plane, but other angles may be selected to obtain a desired movement of the centers of the rails 52. The mechanical fasteners may be implemented by bolts, screws, rivets, etc.

Figure 10:
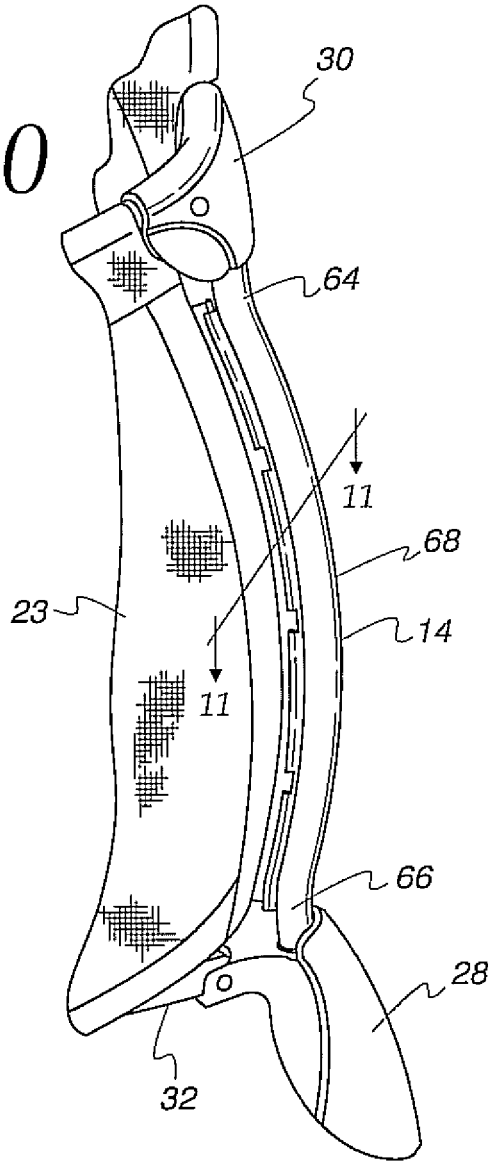
FIG. 10 is an enlarged side view of a post of the example play yard of FIG. 1.

To further enlarge the volume of the play yard 10 and to enhance its rounded appearance, the posts 14 that support the upper frame 26 above the lower frame 24 are curved. In the illustrated example, the posts 14 include a body having a generally straight upper section 64, a generally straight lower section 66, and a curved central section 68 (see FIG. 10). The upper section 64 of each post 14 is coupled to a respective one of the end caps 30 by one or more mechanical fasteners (e.g., rivets). The lower section 66 of each post 14 is coupled to a respective one of the feet 28 by one or more mechanical fasteners (e.g., rivets). Preferably, the curved section 68 of each post is oriented to bow away from the center of the play yard 10 about a generally horizontal axis. The posts 14, like the rails 32, 52 of the lower and upper frames 24, 26, may be constructed of metal (e.g., steel, aluminum, etc.) or of extruded plastic tubes.

As mentioned above, the illustrated play yard 10 includes an enclosure 23 that is supported by the frame 22. Preferably, the enclosure includes five flexible sides, namely, a bottom and four sides. The top is open. The enclosure 23 may be made of fabric, plastic, mesh and/or any other material which is sufficiently strong and durable to define the enclosure volume throughout the desired useful life of the play yard 10 and which is flexible enough to be folded. In the illustrated example, the enclosure 23 is a fabric structure including mesh side panels. The illustrated enclosure 23 includes upper sleeves which receive the rails 52 of the upper frame 26 and lower sleeves which receive the rails 32 of the lower frame 24. In other words, the sides of the enclosure 23 are stretched between the upper and lower frames 24, 26.

Unlike traditional play yards, the posts 14 are not covered or encased in the enclosure 23. Instead, the enclosure 23 of the illustrated play yard is coupled to the inner surface of the posts 14. As a result, the outward facing surfaces, (particularly of the curved sections 68), of the posts 14 are completely exposed.

Figure 11:
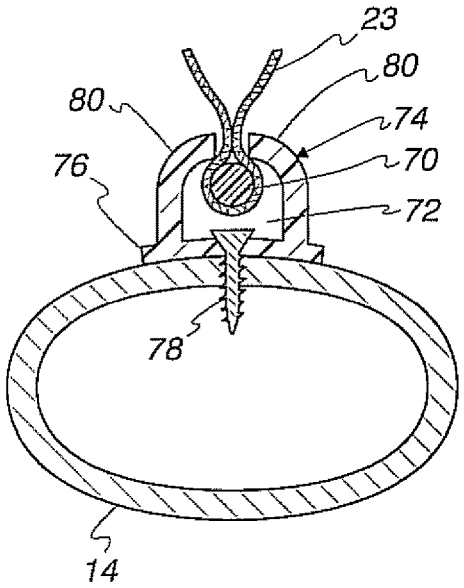
FIG. 11 is a cross-sectional view of the post taken along line 11-11 of FIG. 10.
Figure 12:
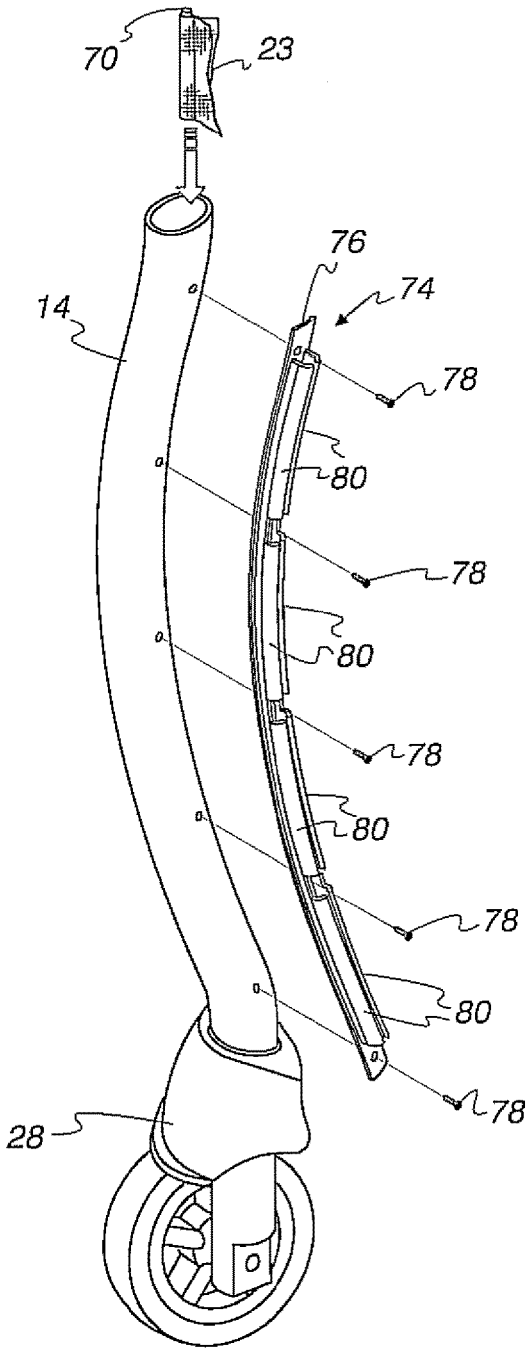
FIG. 12 is an exploded perspective view of another example post of the example play yard of FIG. 1.

In order to facilitate coupling of the enclosure 23 to the posts 14, each of the corners of the enclosure 23 is sewn, glued, fused or otherwise fastened into a sleeve which receives a flexible cylindrical member to define a corner bead 70 as shown in FIGS. 11 and 12. The flexible cylindrical member may be implemented by a wire, a rope, a foam or plastic tube, etc. Further, each post 14 defines a channel 72 for receiving a respective one of the corner beads 70.

In a presently preferred implementation, each channel 72 is defined by a track 74 which is coupled to the exterior of a respective one of the posts 14. Because the tracks 74 are coupled to the inner surfaces of the curved posts 14, the tracks 74 are curved in a manner that complements the post shape. In the example of FIGS. 11 and 12, the track 74 includes a backing 76 which is secured to a respective one of the posts 14 via mechanical fasteners 78 (e.g., rivets, screw, etc.). The channel 72 is defined adjacent the backing 76 by opposed arms 80. Each of the opposed arms 80 has a first end coupled to the backing 76 and a second free end. The free ends of the arms 80 are curved toward one another to define a slit having a width through which the corner bead 70 may not pass. In the illustrated example, four sets of opposed arms 80 are employed, but other numbers of arms 80 (e.g., 1, 2, 3, 5, etc.) might likewise be appropriately employed. The backing 76 and the arms 80 of the illustrated example are integrally formed, since the track 74 is made of molded plastic.

In the example of FIGS. 11 and 12, the tracks 74 are preferably fastened to their corresponding posts 14, and the corner beads 70 are then threaded down into the channels 72 defined by their respective tracks 74. To facilitate assembly, it may be easier to thread the corner beads 70 of the enclosure 23 into their respective channels 72 before assembling the end caps 30 and the upper frame 26 to the posts 14.

Figure 14:
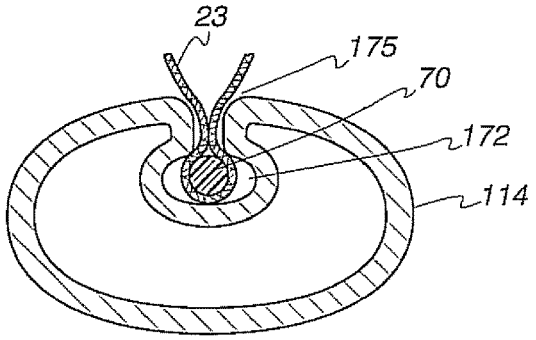
FIG. 14 is a cross-sectional view of the post taken along line 14-14 of FIG. 13*b*.
Figure 13A:
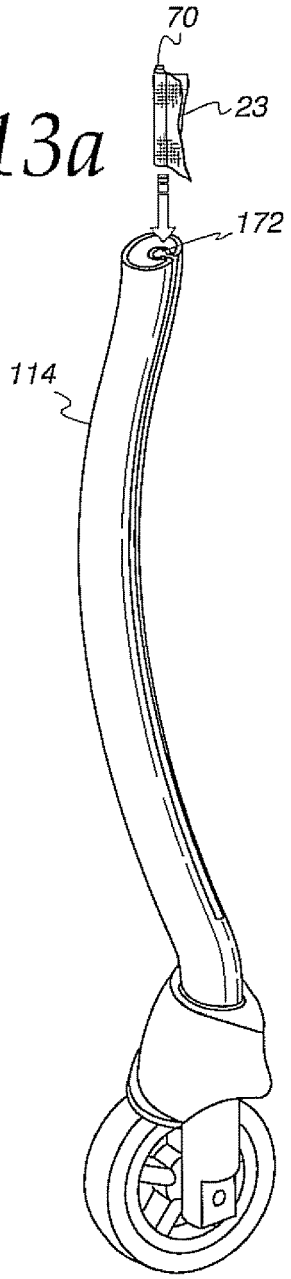
FIG. 13*a* is a perspective view of another example post that may alternatively be used with the example play yard of FIG. 1 showing the post prior to receiving the enclosure.
Figure 13B:
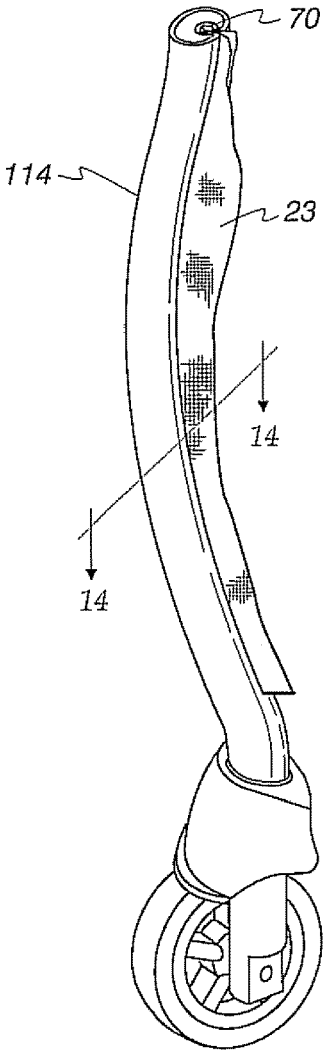
FIG. 13*b* is a perspective view similar to FIG. 13*a*, but showing the enclosure coupled to the post.

An alternative post 14 is shown in FIGS. 13*a*, 13*b* and 14. In the example of FIGS. 13*a*, 13*b* and 14, a post 114 is extruded to define a channel 172. The channel 172 is located within the post 114 and is in communication with a slot 175. The channel 172 follows the shape of the post 114. Thus, in the illustrated example, the channel 172 is curved like the post 114. The enclosure 23 is joined to the post 114 by threading the corner bead 70 down into the channel 172 as shown in FIG. 13*a*. As shown in FIGS. 13*b* and 14, the enclosure 23 passes through the slot 175 when the bead is threaded into the channel 172. However, the slot 175 and the corner bead 70 are sized such that the corner bead 70 may not pass through the slot 175. Although the post 114 requires a more complicated manufacturing process than the post 14, the post 114 has the advantage of not requiring the track 74.

In order to provide a rigid, comfortable support for a child or infant located within the play yard 10, the play yard 10 is further provided with a floor board 90. When the illustrated play yard 10 is erected, the floor board 90 is located within the enclosure 23 on top of the lower frame 24 in a generally horizontal plane (assuming, of course, that the surface on which the play yard 10 is erected is generally horizontal). The illustrated floor board has a rounded rectangular outer perimeter substantially corresponding to the rounded rectangular shape of the upper frame 26. Since the lower frame 24 has a generally rectangular outer shape, portions of the floor board 90 extend outwardly of (i.e., overhang) the lower frame 24.

Other than its shape, the floor board 90 of the illustrated example is conventional. For example, the illustrated floor board 90 includes one or more foam pads secured to one or more boards. The pad(s) and board(s) are encased in a plastic sleeve as is conventional in portable play yards sold today such as the Travelin' Tot® play yards sold by Kolcraft Enterprises. Seams are defined between adjacent boards of the floor board 90 to facilitate folding of the floor board 90 in discrete sections. In the illustrated example, the floor board 90 includes four boards and is foldable in fourths. The floor board 90 may, thus, be wrapping around the collapsed play yard 10 for transport and/or storage.

The floor board 90 may be removably secured to the floor of the enclosure 23 by any suitable fasteners. In the illustrated example, the floor board 90 is secured to the floor of the enclosure 23 by Velcro® strips. Alternatively, the floor board 90 may be held in place by gravity without the benefit of fasteners.

Although certain example methods, apparatus and articles of manufacture have been described herein, the scope of coverage of this patent is not limited thereto. On the contrary, this patent covers all methods, apparatus and articles of manufacture fairly falling within the scope of the claims either literally or under the doctrine of equivalents.

What is claimed is:

1. A play yard comprising:

a collapsible upper frame;

a collapsible lower frame;

posts to support the upper frame above the lower frame, each of the posts having a curved portion;

tracks removably coupled to respective ones of the posts, the tracks to follow a curvature of the curved portion of the respective ones of the posts; and an enclosure operatively coupled to the upper frame, the lower frame and the posts, the enclosure defining an enclosure volume and having a plurality of corner beads dimensioned for receipt in respective ones of the tracks to secure the enclosure to the posts.

2. The play yard of claim 1, wherein each of the posts includes a substantially exposed, outward facing surface.

3. The play yard of claim 1, wherein the enclosure includes first sleeves dimensioned to receive the upper frame and second sleeves dimensioned to receive the lower frame.

4. The play yard of claim 1, wherein the enclosure includes a first side and a second side, the first side and the second side extending from one of the tracks in one of the posts, the first side extending in a first direction and the second side extending in a second direction different than the first direction.

5. The play yard of claim 1, wherein the posts include respective inward facing surfaces relative to the enclosure volume and one of the tracks is associated with the inward facing surface of one of the posts.

6. The play yard of claim 1, wherein the tracks include a first track and a second track and the enclosure includes a first side to extend between a first post including the first track and a second post including the second track, a first end of the first side received in the first track and a second end of the first side received in the second track, the first post and the second post substantially uncovered by the first side when the first and second ends are received in the respective first and second tracks.

7. The play yard of claim 1, wherein one of the tracks is coupled to an exterior of one of the posts.

8. A play yard comprising:

a frame movable between an erected position and a collapsed position, the frame including an upper frame and a lower frame;

a post positioned between the upper frame and the lower frame, the post having a curved inner surface relative to the frame;

a track removably coupled to the inner surface, the track to curve based on a curvature of the inner surface; and an enclosure having a cylindrical member attached to a corner of the enclosure, the cylindrical member received in the track to couple the enclosure to the post.

9. The play yard of claim 8, wherein the enclosure does not cover an outer surface of the post.

10. The play yard of claim 9, wherein the outer surface includes a greater portion of an outer surface area of the post as compared to the inner surface.

11. The play yard of claim 8, wherein the enclosure extends along the inner surface of the post between the upper frame and the lower frame.

12. The play yard of claim 8, wherein the cylindrical member is threaded into the track to couple the enclosure to the post.

13. The play yard of claim 8, wherein an outer surface of the post is to remain exposed when the play yard moves between the erected position and the collapsed position.

14. A play yard comprising:

a first collapsible frame;

a second collapsible frame;

posts to couple the first collapsible frame to the second collapsible frame, the posts including an outwardly bowed portion;

tracks removably coupled to the posts, the tracks follow a curvature of the posts; and an enclosure operatively coupled to the first frame, the second frame and the tracks, the enclosure having a plurality of sides and a bottom, the enclosure having a plurality of corner beads located in respective ones of the tracks to secure the enclosure to the posts;

the enclosure, the first frame, the second frame, and the posts defining a rounded rectangular volume of the play yard.

15. The play yard of claim 14, wherein the tracks are coupled to a portion of the corresponding post opposite the outwardly bowed portion.

16. The play yard of claim 15, wherein the enclosure does not cover the outwardly bowed portion.

* * * * *